US005924695A

United States Patent [19]

Heykoop

[11] Patent Number: 5,924,695

[45] Date of Patent: Jul. 20, 1999

[54] PIRATES TREASURE HUNT GAME AND METHOD OF PLAYING SAME

[76] Inventor: Nancy Heykoop, 27 William St., Lincoln Park, N.J. 07035

[21] Appl. No.: 09/110,337

[22] Filed: Jul. 6, 1998

[51] Int. Cl.[6] ..... A63F 9/00

[52] U.S. Cl. ..... 273/459; 273/440

[58] Field of Search ..... 273/440, 441, 273/444, 459, 461

[56] References Cited

U.S. PATENT DOCUMENTS

| | | | |
|---|---|---|---|
| D. 334,662 | 4/1993 | van Berne | D3/70 |
| 3,707,289 | 12/1972 | Wicks | 273/459 |
| 4,027,877 | 6/1977 | Breslow et al. | 273/459 |
| 4,103,455 | 8/1978 | Silvey | 46/99 |
| 5,248,153 | 9/1993 | Jones | 273/459 |
| 5,429,541 | 7/1995 | Landon | 446/70 |
| 5,613,689 | 3/1997 | Gunday | 273/440 |
| 5,810,364 | 9/1998 | Canion | 273/440 X |

*Primary Examiner*—William E. Stoll

[57] ABSTRACT

A pirates treasure hunt game and method of playing same including a bottle. The bottle has an opening for receiving a cork therein. Included is a map for displaying directions to a treasure. A plurality of seaweed markers are provided. A chest member is included and has a top portion for allowing access into the chest and allowing items to be placed therein. Finally, a plurality of pirate's treasures are included. The treasures consist of a skull ring, a compass, a telescope, an eye patch, a sack of coins, a sword, tattoos, earrings, and other jewelry. The plurality of pirate's treasures is positioned within the chest member prior to burying the chest member. The chest member has a location that is pictured on the map.

6 Claims, 4 Drawing Sheets

FIG. 9
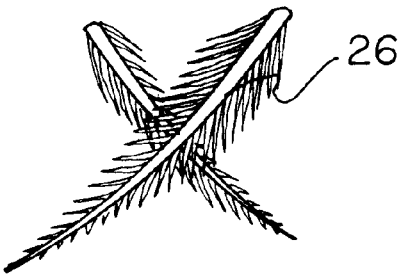
FIG. 10
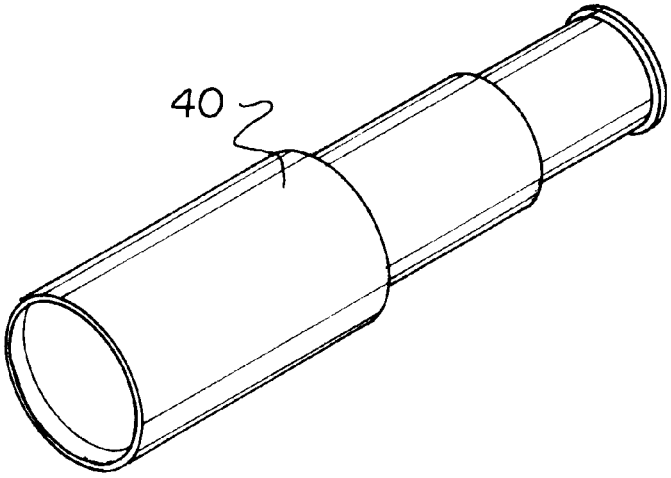
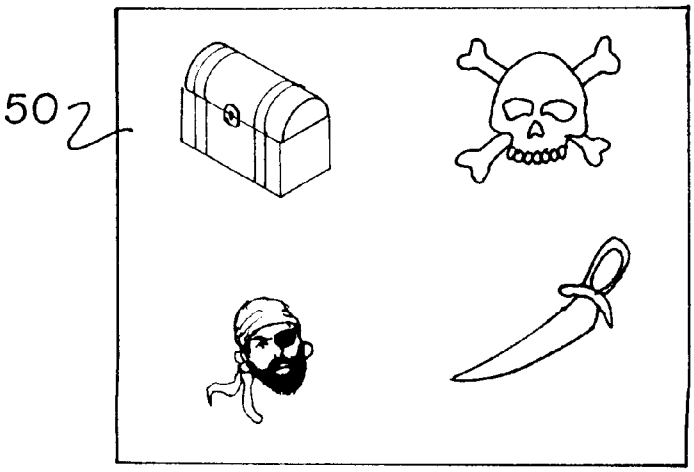
FIG. 11

PIRATES TREASURE HUNT GAME AND METHOD OF PLAYING SAME

BACKGROUND OF THE INVENTION

1. Field of the Invention

The present invention relates to a pirates treasure hunt game and method of playing same and more particularly pertains to providing an easy to play and entertaining game of treasure hunt.

2. Description of the Prior Art

The use of a treasure hunt game is known in the prior art. More specifically, treasure hunt games heretofore devised and utilized for the purpose of entertainment are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 4,569,527 to Rosenwinkel, Breslow, and Zaruba discloses a treasure game with separable, changeable surfaces. U.S. Pat. No. 4,077,630 to Kindred discloses a board game. U.S. Pat. No. Des. 333,323 to Nelson and Isaak discloses a treasure hunt game. U.S. Pat. No. 5,380,013 Nacht discloses an apparatus for board games. U.S. Pat. No. 5,435,566 to Scuderi discloses a windsurfing board game. Lastly, U.S. Pat. No. 5,236,200 to McGregor et at. discloses a card-like structure.

In this respect, the pirates treasure hunt game and method of playing same according to the present invention substantially departs from the conventional concepts and designs of the prior art, and in so doing provides an apparatus primarily developed for the purpose of providing an easy to play and entertaining game of treasure hunt.

Therefore, it can be appreciated that there exists a continuing need for a new and improved pirates treasure hunt game and method of playing same which can be used for providing an easy to play and entertaining game of treasure hunt. In this regard, the present invention substantially fulfills this need.

SUMMARY OF THE INVENTION

In view of the foregoing disadvantages inherent in the known types of treasure hunt game now present in the prior art, the present invention provides an improved Pirates treasure hunt game and method of playing same. As such, the general purpose of the present invention, which will be described subsequently in greater detail, is to provide a new and improved pirates treasure hunt game and method of playing same which has all the advantages of the prior art and none of the disadvantages.

To attain this, the present invention essentially comprises a bottle. The bottle has an opening for receiving a cork. A map is provided. The map is for displaying directions to a treasure. The map is rolled into a cylindrical member and placed into the bottle.

Included are a plurality of seaweed markers. The seaweed markers are for positioning on a receiving surface and marking the location of the treasure.

Also, a generally rectangular chest member is provided. The chest member has a top portion for allowing access into the chest and to allow items to be placed therein. The chest member has a locking mechanism for securing the items positioned within the chest member.

Lastly, a plurality of pirate's treasures are including. The pirate's treasure is made up of a skull ring, a compass, a telescope, an eye patch, a sack of coins, a sword, tattoos, earrings, and other jewelry. The plurality of pirate's treasures is positioned within the chest member prior to burying the chest member.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is riot limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved pirates treasure hunt game and method of playing same which has all the advantages of the prior art treasure hunt games and none of the disadvantages.

It is another object of the present invention to provide a new and improved pirates treasure hunt game and method of playing same which may be easily and efficiently manufactured and marketed.

It is a further object of the present invention to provide a new and improved pirates treasure hunt game and method of playing same which is of a durable and reliable construction.

An even further object of the present invention is to provide a new and improved pirates treasure hunt game and method of playing same which is susceptible of a low cost of manufacture with regard to both materials and labor, and which accordingly is then susceptible of low prices of sale to the consuming public, thereby making such pirates treasure hunt game and method of playing same economically available to the buying public.

Still yet another object of the present invention is to provide a new and improved pirates treasure hunt game and method of playing same which provides in the apparatuses and methods of the prior art some of the advantages thereof, while simultaneously overcoming some of the disadvantages normally associated therewith.

Still another object of the present invention is to provide an easy to play and entertaining game of treasure hunt. Lastly, it is an object of the present invention to provide a new and improved game that has a bottle. The bottle has an opening for receiving a cork therein. Included is a map for displaying directions to a treasure. A plurality of seaweed markers are provided. A chest member is included and has a top portion for allowing access into the chest and allowing items to be placed therein. Finally, a plurality of pirate's treasures are included. The treasures consist of a skull ring, a compass, a telescope, an eye patch, a sack of coins, a sword, tattoos, earrings, and other jewelry. The plurality of pirate's treasures is positioned within the chest member prior to burying the chest member. The chest member has a location that is pictured on the map.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 9 is an isometric view of the seaweed of the present invention.

FIG. 10 is an isometric view of the telescope of the present invention.

FIG. 11 is an isometric view of the tattoos of the present invention.

Similar reference characters refer to similar parts throughout the several views of the drawings.

DESCRIPTION OF THE PREFERRED EMBODIMENT

Figure 1:
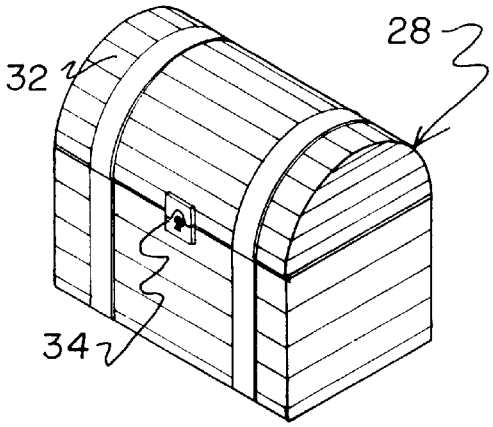
FIG. 1 is an isometric view of the chest member of the pirates treasure hunt game of the present invention.

With reference now to the drawings, and in particular to FIG. 1 thereof, a new and improved pirates treasure hunt game and method of playing same embodying the principles and concepts of the present invention and generally designated by the reference numeral 12-0 will be described.

The present invention, the new and improved pirates treasure hunt game and method of playing same, is comprised of a plurality of components. Such components in their broadest context include a map, a chest member and pirate's treasure. Such components are individually configured and correlated with respect to each other so as to attain the desired objective.

Figure 4:
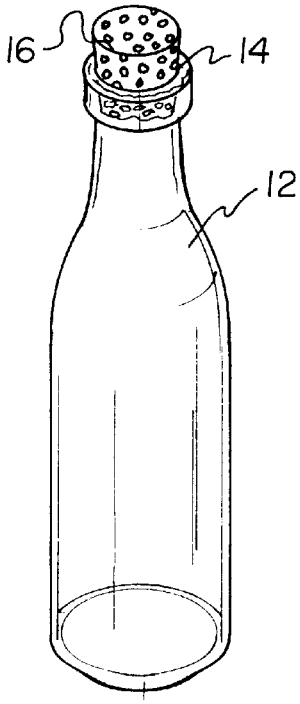
FIG. 4 is a side view of the bottle of the present invention.
Figure 5:
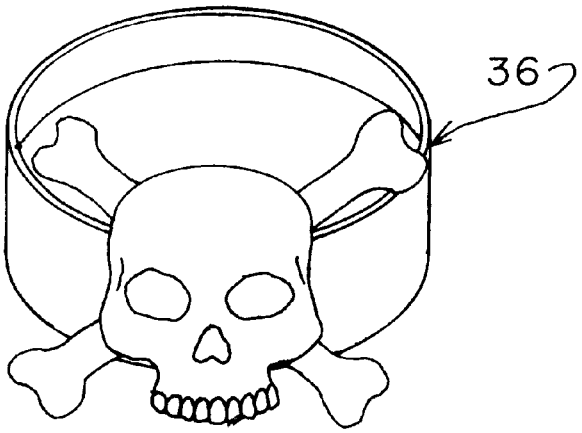
FIG. 5 is an isometric view of the skull ring of the present invention.
Figure 6:
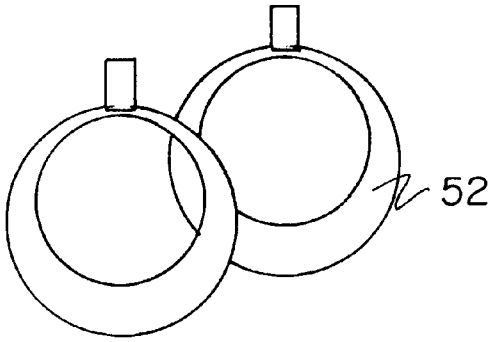
FIG. 6 is an isometric view of the earrings of the present invention.
Figure 7:
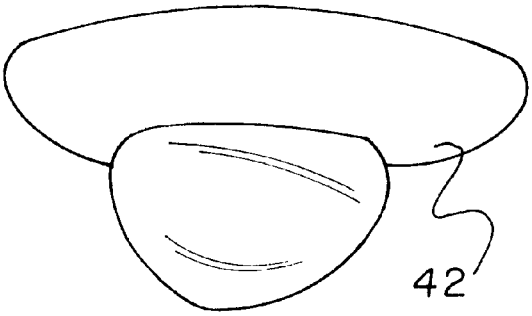
FIG. 7 is an isometric view of the eye patch of the present invention.
Figure 8:
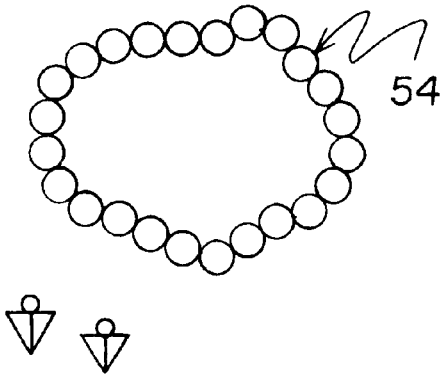
FIG. 8 is an isometric view of the jewelry of the present invention.
Figure 12:
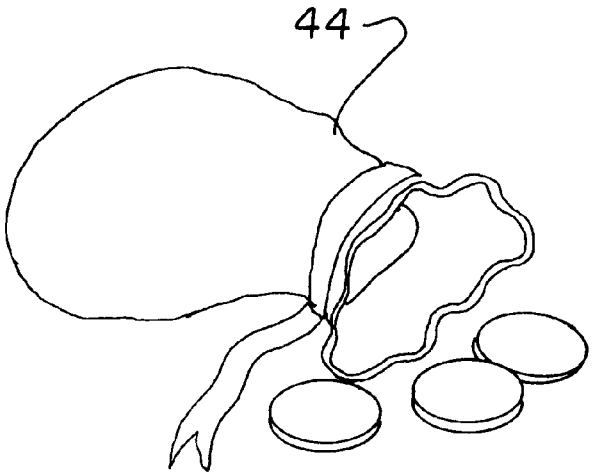
FIG. 12 is an isometric view of the sack of coins of the present invention.
Figure 13:
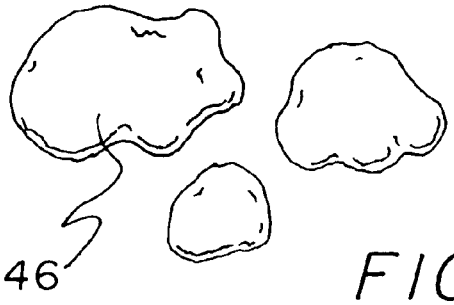
FIG. 13 is an isometric view of the gold nuggets of the present invention.
Figure 14:
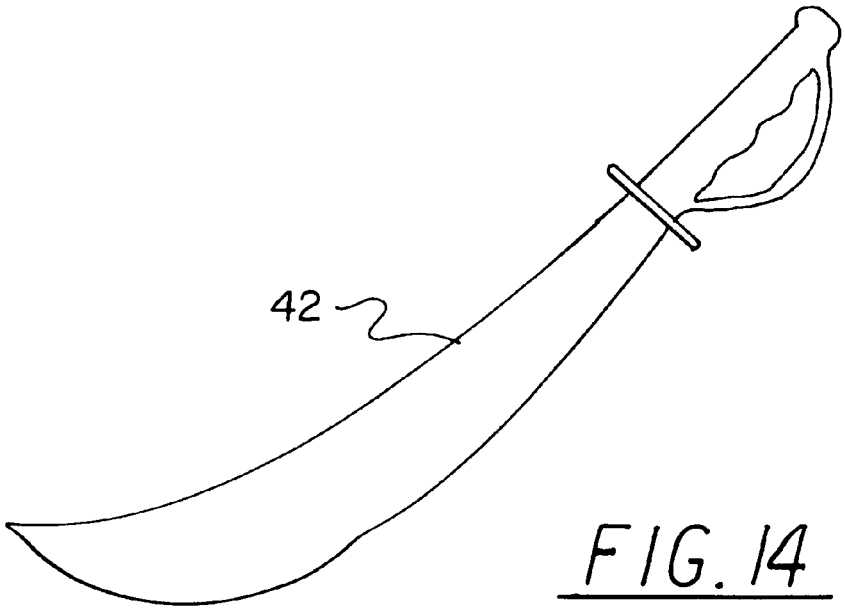
FIG. 14 is an isometric view of the sword of the present invention.

More specifically, the present invention includes a bottle 12, as seen in FIG. 4. The bottle has an opening 14 for receiving a cork 16. The bottle may be made of glass or plastic. Preferably the bottle is a clear plastic bottle. The cork is a standard cork that will make the bottle air tight and disallow water seepage into the bottle.

Figure 2:
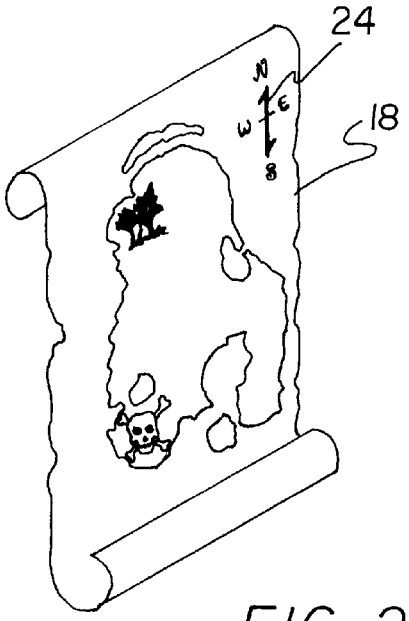
FIG. 2 is an isometric view of the map of the present invention.
Figure 3:
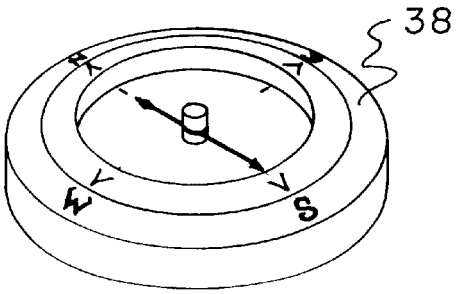
FIG. 3 is an isometric view of the compass of the present invention.

Also, as shown in FIG. 2 a map 18 is provided. The map is for displaying directions to a treasure. The map has indicia 24. The indicia depicts direction, trees and a skull and cross-bone. The map is rolled into a cylindrical member and placed into the bottle. Once the map is in the bottle, the bottle is sealed with the cork 16.

Included are a plurality of seaweed markers 26. The seaweed marker are plastic so as to last a long time when used in and around water. The seaweed markers are positioned on a receiving surface and marking the location of the treasure. Note FIG. 9.

Also, a generally rectangular chest member 28 is provided. As illustrated in FIG. 1, the chest member has a top portion 32. The top portion allows access into the chest and allows items to be placed within. The chest member has a locking mechanism 34 for securing the items positioned within the chest member. The chest member may be plastic or wood, either material would satisfy the games requirements. But, plastic is preferred because it is lighter and has a longer life when around water.

Lastly, a plurality of pirate's treasures are including. The pirate's treasure is made up of a skull ring 36, a compass 38, a telescope 40, an eye patch 42, a sack of coins 44, gold nuggets 46, a sword 48, tattoos 50, earrings 52 and other jewelry 54. The plurality of pirate's treasures is positioned within the chest member prior to burying the chest member.

The pirate's treasure hunt game is easy to play. The method of playing a pirates treasure hunt game in which the players must find a chest of treasures includes only a few steps. To begin there are a plurality of players. The players are divided into hiders and hunters. The hiders are the first set of players and the hunters are the second set of players.

The game is started by placing pirate's treasure within a chest member and locking the pirate's treasure therein. This is done by a first set of players. Next, the first set of players must find a spot and burying the chest member containing the pirate's treasure.

The first set of players then pace off steps from the buried chest member to a starting location. While pacing they are drawing those steps onto the map as directions to the chest member.

The first set of players then roll the map into a cylinder and placing the map into a bottle. The bottle is then sealed with the map within and the bottle has the cork placed in its opening. The first set of players then place the sealed bottle with the map along the seashore for finding by the second set of players of the game.

The sealed bottle is picked up by a second set of players. The second set of players review the map arid attempt to follow its directions to the chest member. Finally, finishing the game comes when the second set of players find the chest member and take the pirate's treasure from the chest member for use.

The present invention is to let a child's imagination take them on a pirate's treasure hunt adventure. The adults bury the chest member with the treasure. The adults fill in the map and leave for the children to find.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved pirates treasure hunt game for increasing children's imagination, comprising in combination:

a bottle having an opening for receiving a cork therein;

a map for displaying directions to a treasure, the map being rolled into a cylindrical member for placement into the bottle;

a plurality of seaweed markers for positioning on a receiving surface and marking the location of the treasure;

a generally rectangular chest member having a top portion for allowing access into the chest and items placed therein, the chest member having a locking mechanism for securing the items positioned within the chest member; and plurality of pirate's treasures including a skull ring, a compass, a telescope, an eye patch, a sack of coins, a sword, tattoos, earrings, and other jewelry, the plurality of pirate's treasures being positioned within the chest member prior to burying the chest member.

2. A pirates treasure hunt game comprising:

a bottle having an opening for receiving a cork therein;

a map for displaying directions to a treasure;

a plurality of seaweed markers;

a chest member having a top portion for allowing access into the chest and items placed therein; and a plurality of pirate's treasures including a skull ring, a compass, a telescope, an eye patch, a sack of coins, a sword, tattoos, earrings, and other jewelry, the plurality of pirate's treasures being positioned within the chest member prior to burying the chest member, the chest member having a location being pictured on the map.

3. The pirates treasure hunt game as set forth in claim 2, wherein the map being rolled into a cylindrical member for placement into the bottle.

4. The pirates treasure hunt game as set forth in claim 2, wherein the plurality of seaweed markers being positioned on a receiving surface and marking the location of the treasure.

5. The pirates treasure hunt game as set forth in claim 2, wherein the chest member having a locking mechanism for securing the items positioned within the chest member.

6. A method of playing a pirates treasure hunt game in which the players must find a chest of treasures comprising the steps of:

placing pirate's treasure within a chest member and locking the pirate's treasure therein by a first set of players;

finding a spot and burying the chest member with the pirate's treasure within;

pacing off steps from the buried chest member to a starting location and drawing those steps onto the map as directions to the chest member;

rolling the map into a cylinder and placing the map into a bottle;

sealing the map within the bottle with a cork and placing the sealed bottle with the map along the seashore for finding by players of the game; and picking up the sealed bottle by a second set of players, the second set of players review the map and attempt to follow its directions to the chest member; and finishing the game comes when the second set of players find the chest member and take the pirate's treasure from the chest member for use.

* * * * *